US009169545B2

(12) United States Patent
Padula, II et al.

(10) Patent No.: US 9,169,545 B2
(45) Date of Patent: Oct. 27, 2015

(54) MECHANICAL COMPONENTS FROM HIGHLY RECOVERABLE, LOW APPARENT MODULUS MATERIALS

(75) Inventors: Santo Padula, II, Valley City, OH (US); Ronald D. Noebe, Medina, OH (US); Malcolm K. Stanford, Parma Heights, OH (US); Christopher DellaCorte, Sharon Township, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 502 days.

(21) Appl. No.: 12/894,444

(22) Filed: Sep. 30, 2010

(65) Prior Publication Data

US 2012/0080123 A1 Apr. 5, 2012

(51) Int. Cl.
*C22F 1/18* (2006.01)
*C22F 1/00* (2006.01)

(52) U.S. Cl.
CPC ..... *C22F 1/18* (2013.01); *C21D 2201/01* (2013.01)

(58) Field of Classification Search
USPC ..... 148/402, 508
See application file for complete search history.

(56) References Cited

U.S. PATENT DOCUMENTS

| | | | | |
|---|---|---|---|---|
| 5,611,874 | A * | 3/1997 | Zadno-Azizi et al. | 148/402 |
| 6,329,069 | B1 * | 12/2001 | Azizi et al. | 428/600 |
| 2003/0010413 | A1 * | 1/2003 | Homma | 148/563 |

* cited by examiner

*Primary Examiner* — Kaj K Olsen
*Assistant Examiner* — Alexander Polyansky
(74) *Attorney, Agent, or Firm* — Robert H. Earp, III

(57) ABSTRACT

A material for use as a mechanical component is formed of a superelastic intermetallic material having a low apparent modulus and a high hardness. The superelastic intermetallic material is conditioned to be dimensionally stable, devoid of any shape memory effect and have a stable superelastic response without irrecoverable deformation while exhibiting strains of at least 3%. The method of conditioning the superelastic intermetallic material is described. Another embodiment relates to lightweight materials known as ordered intermetallics that perform well in sliding wear applications using conventional liquid lubricants and are therefore suitable for resilient, high performance mechanical components such as gears and bearings.

13 Claims, 12 Drawing Sheets

| MATERIAL | ELASTIC MODULUS, GPA | ROCKWELL C HARDNESS NUMBER, HRC |
|---|---|---|
| STELLITE 6B | 210 (30.4) | 44 - 46 |
| 440 C | 207 (30) | 58 - 60 |
| M50 | 207 (30) | 60 - 63 |
| 60NiTi | 100 (15) | 58 - 62 |

| MATERIAL | ELASTIC MODULUS, GPA | ROCKWELL C HARDNESS NUMBER, HRC |
|---|---|---|
| STELLITE 6B | 210 (30.4) | 44 - 46 |
| 440 C | 207 (30) | 58 - 60 |
| M50 | 207 (30) | 60 - 63 |
| 60NiTi | 100 (15) | 58 - 62 |

| MATERIAL | ELASTIC MODULUS, GPA | BRINELL HARDNESS NUMBER, BHN | MODELL NUMBER |
|---|---|---|---|
| STELLITE 6B | 210 (30.4) | 302 | 9.9 |
| 440 C | 207 (30) | 434 | 14.5 |
| M50 | 207 (30) | 493 | 16.4 |
| 60NiTi | 100 (15) | 531 | 37.9 |

FIG. 3

| PLATE MATERIAL | INDENTER | THRESHOLD LOAD, kgf (lbs) | PEAK STRESS, GPa (ksi) | CONTACT DIA., mm (in) | PEAK STRESS, GPa (ksi) |
|---|---|---|---|---|---|
| STELLITE 6B | $Si_3N_4$ | 10 (22) | 2.06 (299) | 0.30 (0.012) | 1.37 (199) |
| 440 C | $Si_3N_4$ | 51 (112) | 3.48 (504) | 0.52 (0.021) | 2.32 (336) |
| M50 | $Si_3N_4$ | 150 (331) | 5.09 (738) | 0.74 (0.029) | 3.39 (491) |
| 60NiTi | $Si_3N_4$ | 552 (1214) | 5.56 (806) | 1.36 (0.054) | 3.71 (537) |
| STELLITE 6B | 60NiTi | 15 (33) | 1.56 (226) | 0.42 (0.017) | 1.04 (151) |
| 440 C | 60NiTi | 150 (331) | 3.33 (483) | 0.92 (0.036) | 2.22 (322) |
| M50 | 60NiTi | 501 (1102) | 5.02 (728) | 1.37 (0.054) | 3.35 (486) |
| 60NiTi | 60NiTi | 1512 (3327) | 5.90 (856) | 2.19 (0.086) | 3.94 (571) |

FIG. 4

| PLATE MATERIAL | INDENTER MATERIAL | WEIGHT DROP HEIGHT, mm | DENT DIAMETER, mm |
|---|---|---|---|
| 440 C | M50 | 25 | 1.5 |
| 440 C | $Si_3N_4$ | 12 | 1.5 |
| 60NiTi | M50 | 25 | NO DENT |
| 60NiTi | $Si_3N_4$ | 12 | NO DENT |

| DISK | COEFFICIENT OF FRICTION | DISK WEAR, $\mu m^3$ | RIDER WEAR, $mm^3$ |
|---|---|---|---|
| Ti | 0.13 | 39.8 | 0.47 |
| $Ti_3Al$ - Nb | 0.15 | 14.9 | 0.39 |

MECHANICAL COMPONENTS FROM HIGHLY RECOVERABLE, LOW APPARENT MODULUS MATERIALS

STATEMENT REGARDING FEDERALLY SPONSORED RESEARCH OR DEVELOPMENT

The invention described herein was made by an employee of the United States Government and may be manufactured and used by or for the Government for Government purposes without the payment of any royalties thereon or therefore.

TECHNICAL FIELD

The invention relates to shock resistant, resilient bearings and mechanical components, and more particularly to bearings and mechanical components made from hard, highly recoverable, low apparent modulus materials.

BACKGROUND

Materials for high performance bearings, gears and other mechanical components require a number of specific properties and characteristics. Among these key attributes are high strength and hardness, high thermal conductivity, and the ability to be manufactured to very high levels of precision with regards to final dimensions and surface finish. In addition, excellent corrosion resistance and good tribological properties are important, especially for applications in extreme environments.

In rotorcraft, for instance, engine bearings, rotor mechanisms and drive systems are obvious examples where improved corrosion resistance is a benefit. Flight and water vehicles exposed to marine environments are also prone to corrosion related failures despite the widespread use of lubricants with corrosion inhibitors. Even spaceflight hardware destined to operate in the vacuum of space, beyond the realm of atmospheric corrosion, often must be stored for extended periods before launch, and are subject to bearing and gear corrosion problems. In select applications involving electric machines and sensitive instrumentation, good electrical conductivity and nonmagnetic properties can also be highly desirable. Unfortunately, no currently deployed material possesses all of these properties.

SUMMARY OF THE INVENTION

In accordance with the present invention, a shape memory alloy (SMA) for use as a component is formed of an intermetallic material. The intermetallic material has a stable superelastic response with recoverable strains of at least 3%.

Further in accordance with the present invention, a method of conditioning a shape memory alloy (SMA) for use as a component requires selecting the shape memory alloy from an intermetallic material. Then, the shape memory alloy is maintained at a constant temperature above the austenite finish temperature of the shape memory alloy and below the recrystallization temperature of the shape memory alloy. Continuing, different values of stress are applied on the shape memory alloy until alloy failure. Next the strains due to the different values of stress are measured. A value of stress for isothermal conditioning of the shape memory alloy is selected whereby the alloy is made dimensionally stable by removing all evidence of irrecoverable deformation through the conditioning.

Also in accordance with the present invention, a mechanical component for tribological applications is selected from an ordered intermetallic shape memory alloy selected from the group of materials including Nitinol, NiTi, NiTiXY (where X, Y could be Hf, Zr, Fe, Pd, Pt, Cu, Cr, Nb and Au), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior. The ordered intermetallic shape memory alloy is a hard material, having an austenite finish temperature ($A_f$) below the intended use temperature of the component. The ordered intermetallic shape memory alloy has been conditioned to eliminate irrecoverable deformation in the material providing stable superelastic response.

BRIEF DESCRIPTION OF THE DRAWINGS

Reference will be made in detail to embodiments of the disclosure, examples of which may be illustrated in the accompanying drawing Figures. The Figures are intended to be illustrative, not limiting. Although the invention is generally described in the context of these embodiments, it should be understood that it is not intended to limit the invention to these particular embodiments.

Certain elements in selected ones of the Figures may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity. In some cases, hidden lines may be drawn as dashed lines but in other cases they may be drawn as solid lines.

Figures 1, 2:
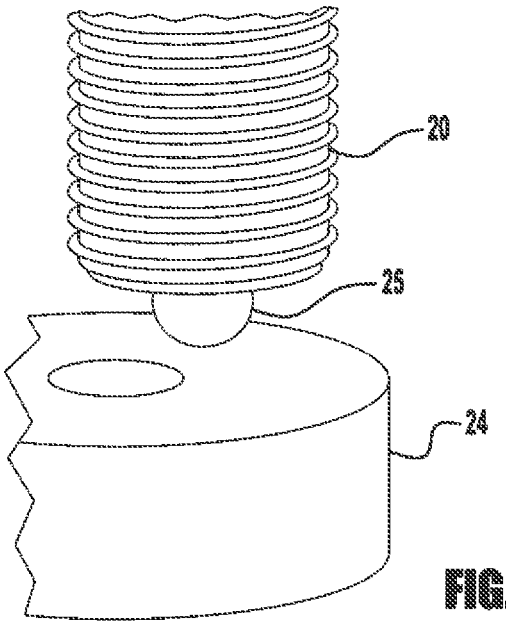

If shading or cross-hatching is used, it is not intended to be of use in distinguishing one element from another. It should be understood that it is not intended to limit the disclosure due to shading or cross-hatching in the drawing Figures.

FIG. 1 is a chart showing the elastic modulus (or apparent modulus in the case of NiTi) and Rockwell C hardness values for various materials, in accordance with one or more embodiments of the present invention.

FIG. 2 is an illustration of an indenter, according to the present invention.

FIG. 3 is a chart showing Brinell hardness values and Modell numbers for the various materials of FIG. 1, in accordance with one or more embodiments of the present invention.

FIG. 4 is a chart showing threshold loads above which permanent dents occur in various plate surfaces for the various materials of FIG. 1 when indented with $Si_3N_4$ and 60 NiTi balls, along with calculated hertz contact stresses and contact ball diameters at the threshold load for dent formation for various plate and indenter material in accordance with one or more embodiments of the present invention.

Figure 5:
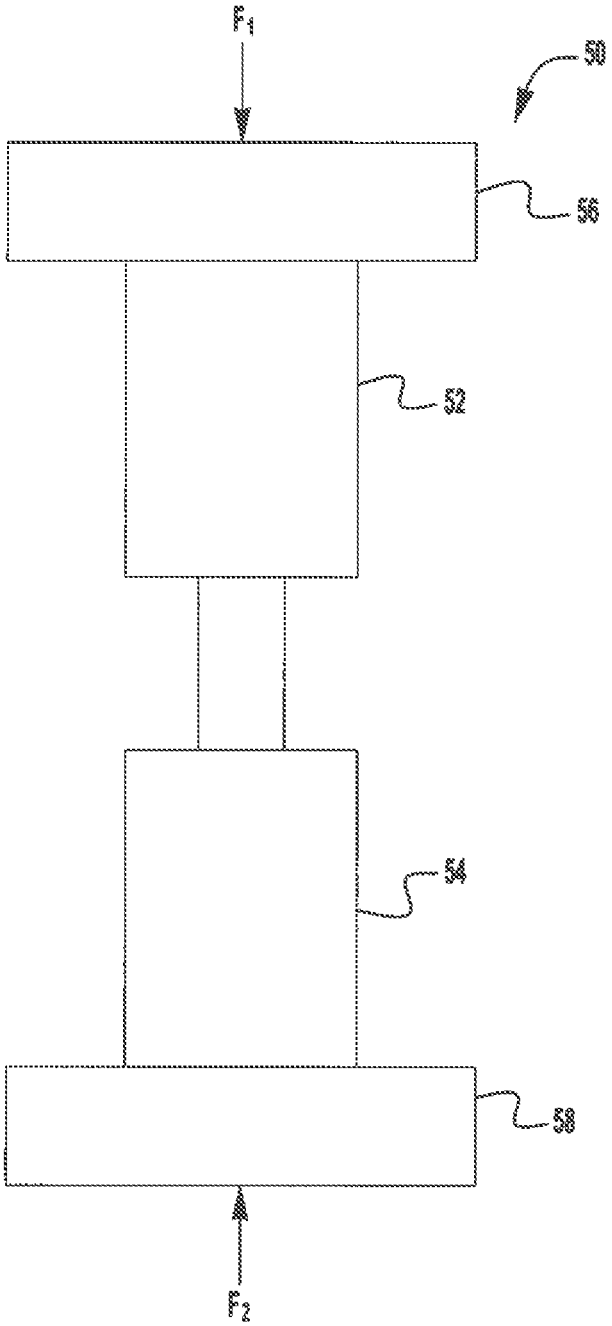

FIG. 5 is a schematic of a servo-hydraulic test frame, in accordance with one or more embodiments of the present invention.

Figure 6:
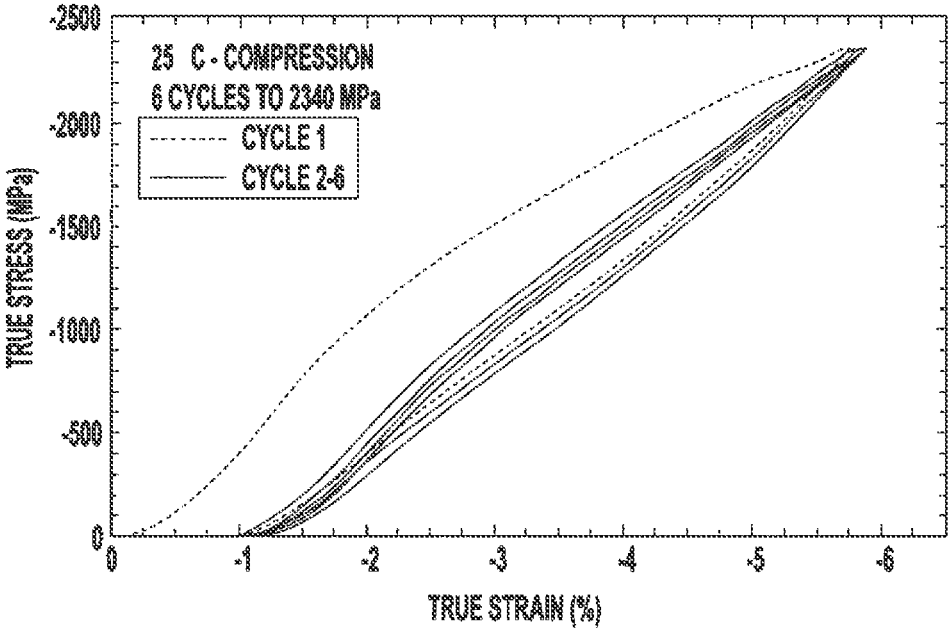

FIG. 6 is a graph showing the compression behavior of 60 NiTi, in accordance with one or more embodiments of the present invention.

Figure 7:
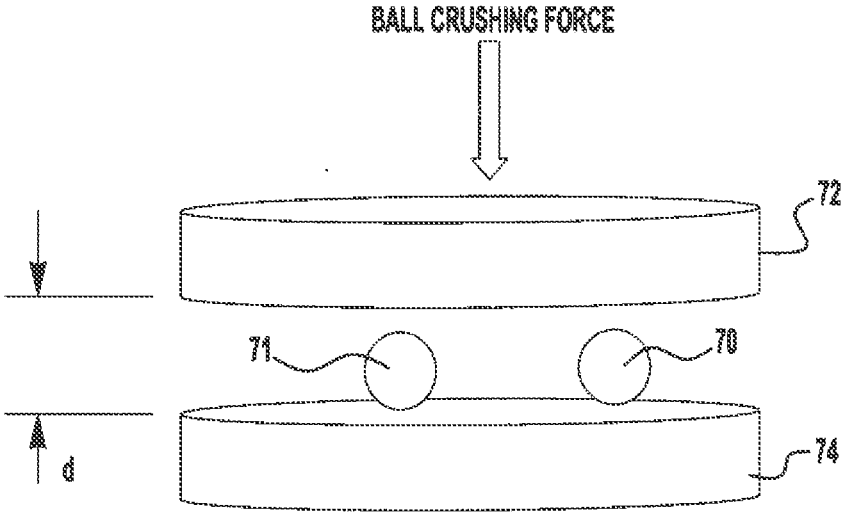

FIG. 7 is a schematic illustration of a ball crush test device, in accordance with one or more embodiments of the present invention.

Figures 8, 9:
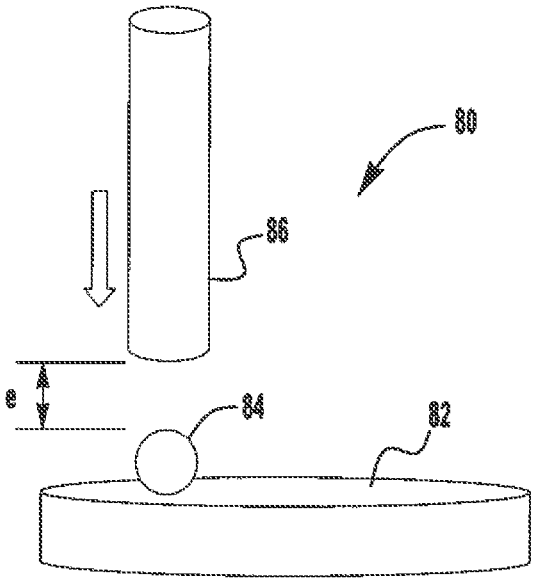

FIG. 8 is a schematic illustration of a drop impact test, in accordance with one or more embodiments of the present invention.

FIG. 9 is a chart showing shock impact test results for the various materials of FIG. 1, in accordance with one or more embodiments of the present invention.

Figure 10:
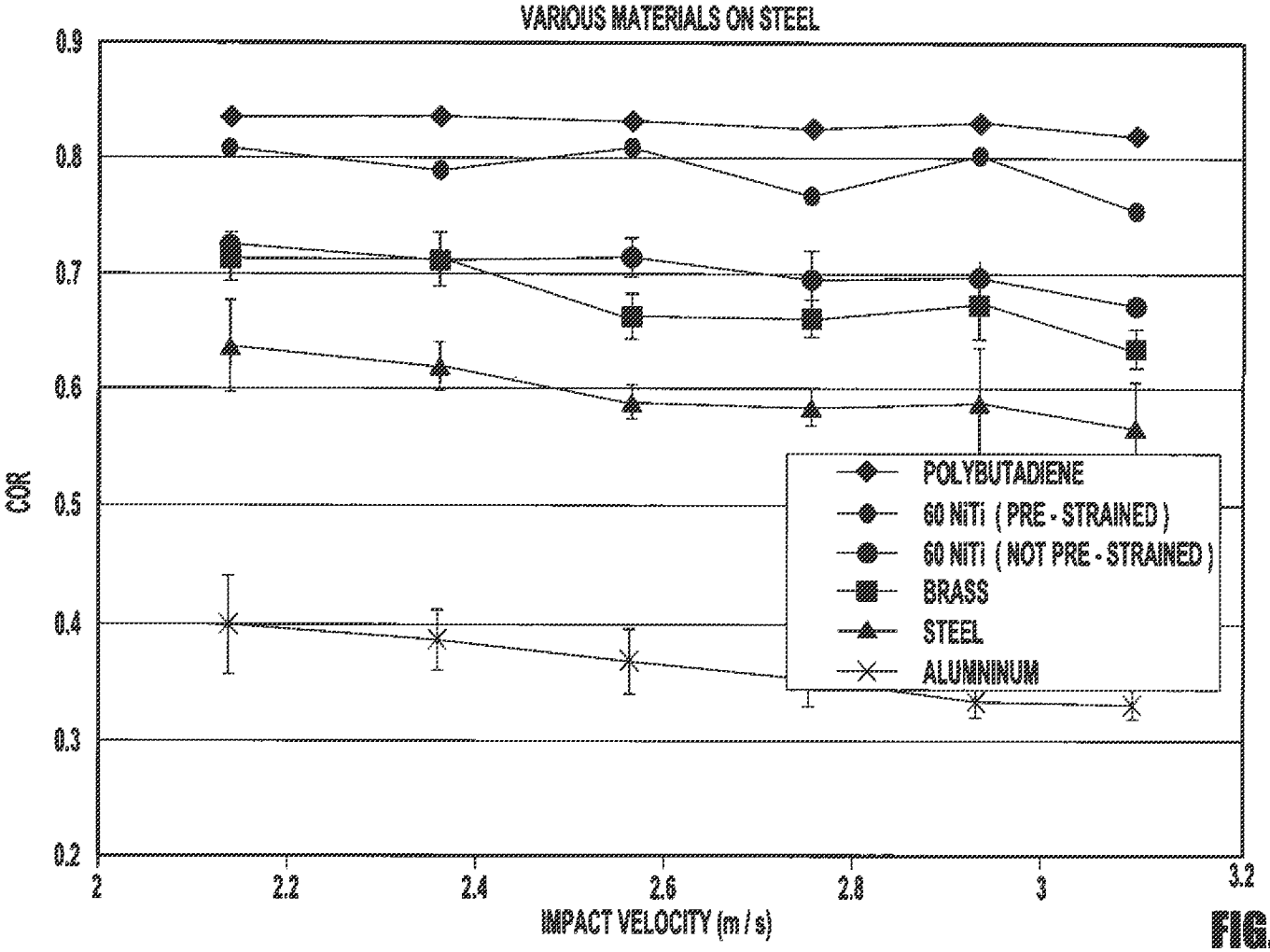

FIG. 10 is a graph showing ball rebound coefficient of restitution results for 60 NiTi balls in two states; one that has been prestrained (labeled original) and one without prestrain (labeled new), in accordance with one or more embodiments of the present invention.

Figure 11:
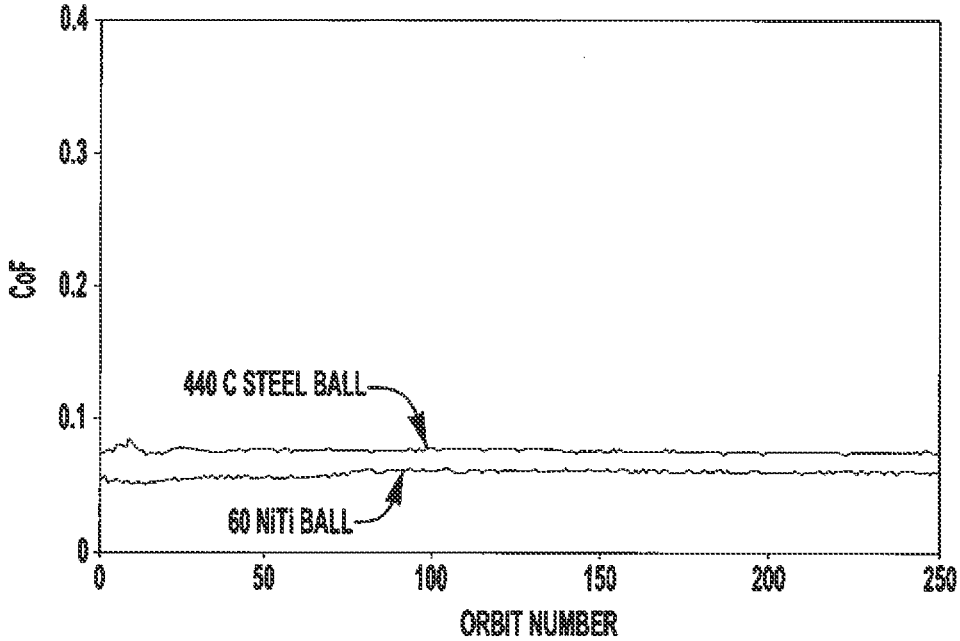

FIG. 11 is a graph showing initial friction traces for a steel ball and a 60 NiTi ball rolling against a steel plate, in accordance with one or more embodiments of the present invention.

Figure 12:
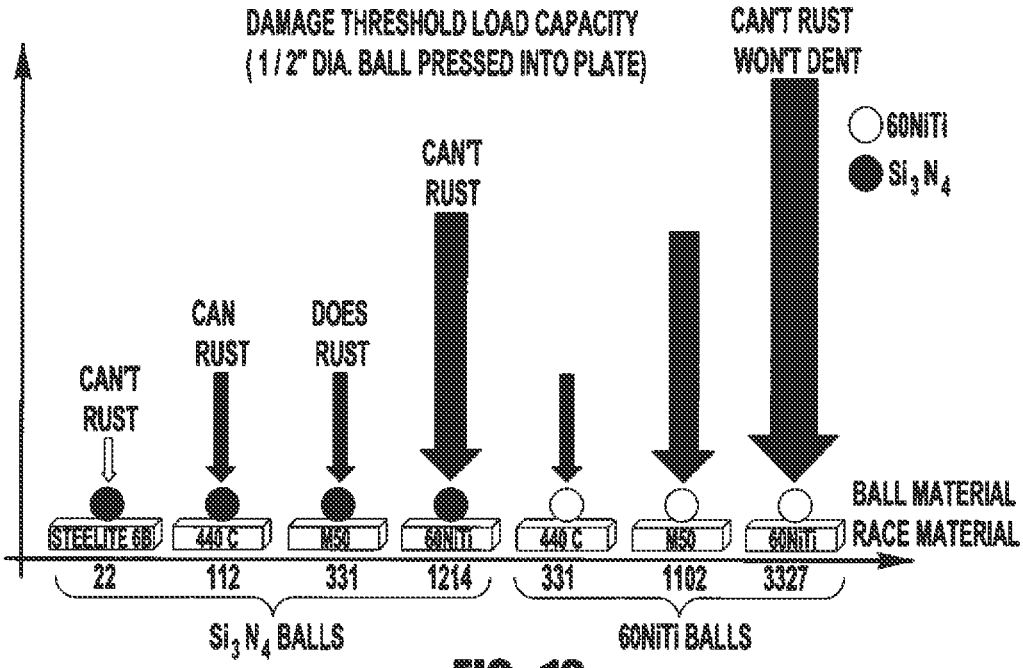

FIG. 12 is a chart showing the damage threshold load capacity for various bearing material combinations for the various materials of FIG. 1, in accordance with one or more embodiments of the present invention.

Figure 13:
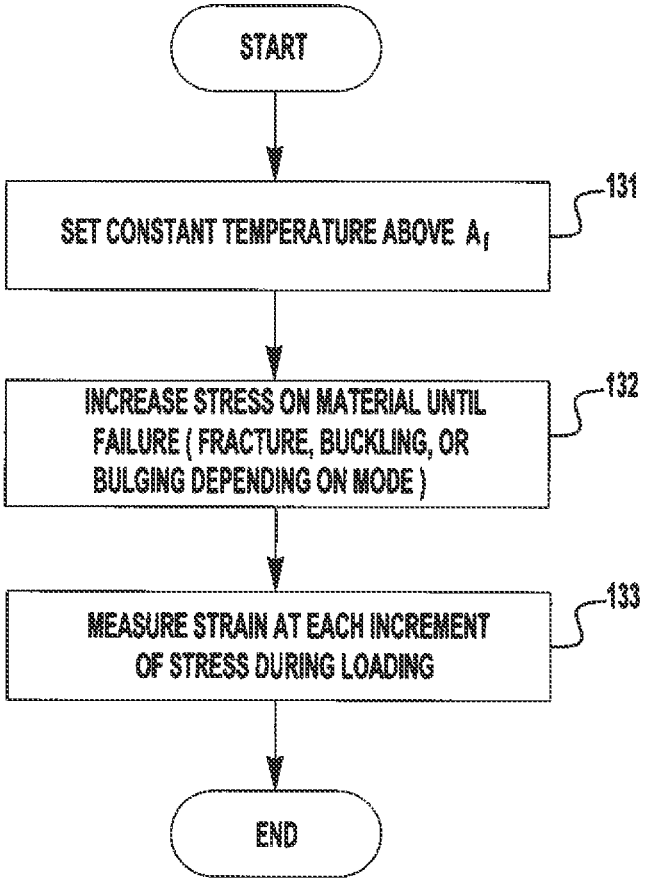

FIG. 13 illustrates a method for determining failure stress during loading on a processed SMA material, in accordance with one or more embodiments of the present invention.

Figure 14:
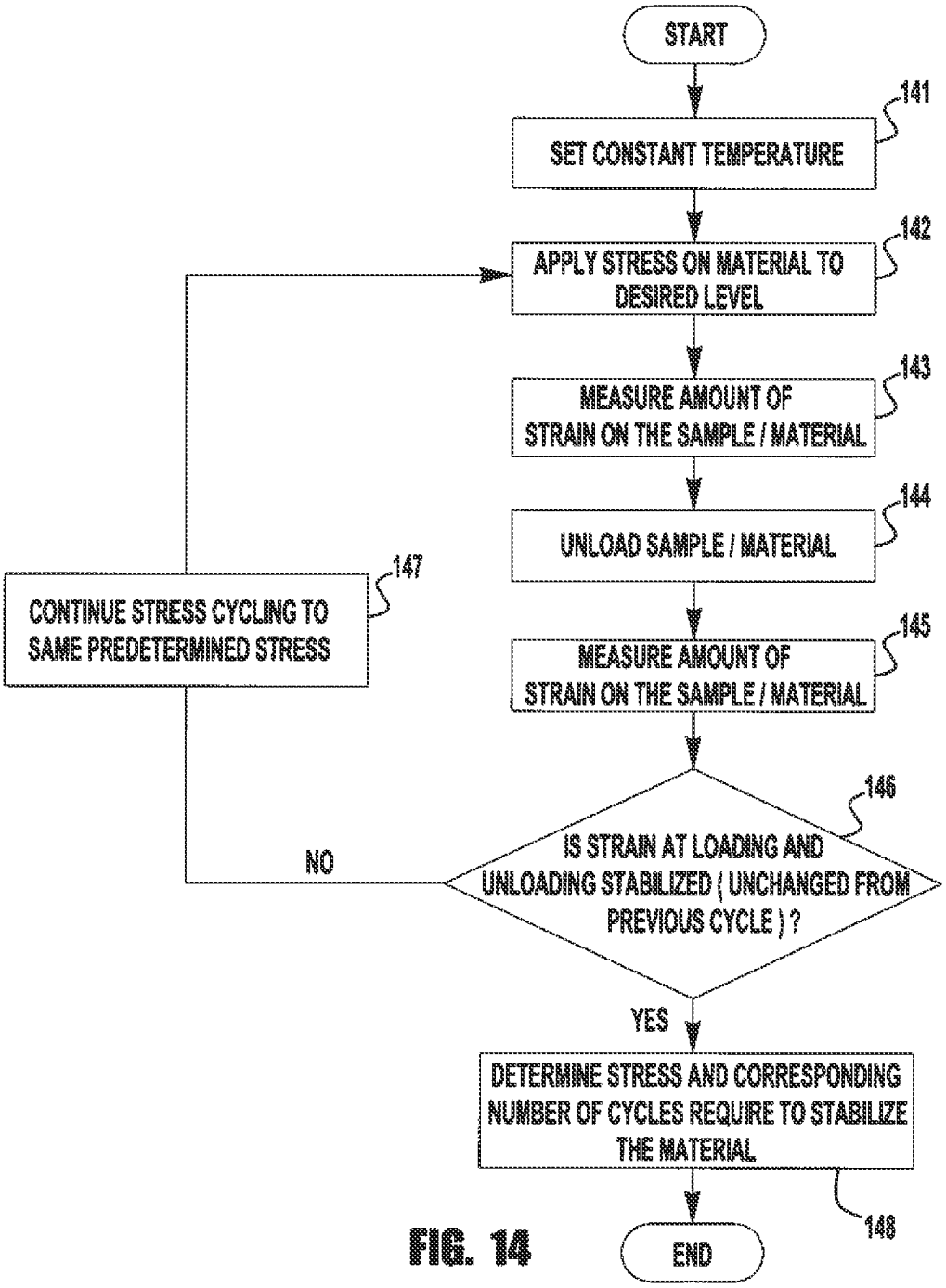

FIG. 14 illustrates a method for determining the stress required to stabilize a processed SMA material, in accordance with one or more embodiments of the present invention.

Figure 15:
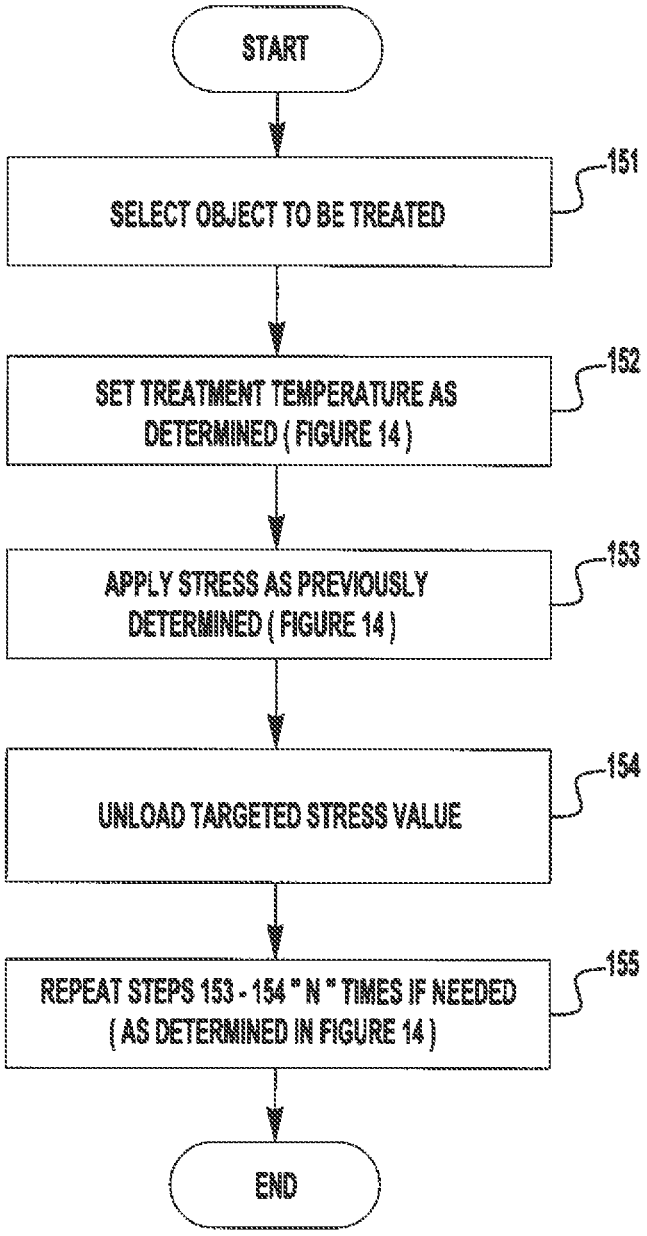

FIG. 15 illustrates a method for performing isothermal mechanical cycling on a sample of a SMA, in accordance with one or more embodiments of the present invention.

Figures 16, 17:
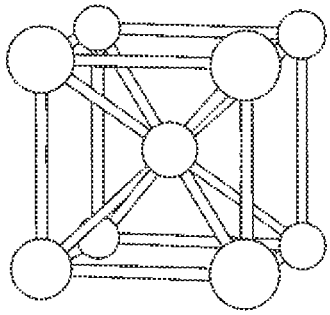

FIG. 16 is a schematic illustration of the crystal structure of an ordered, intermetallic alloy, in accordance with one or more embodiments of the present invention.

FIG. 17 is a chart showing comparative property values for intermetallic materials compared with conventional bearing alloys, in accordance with one or more embodiments of the present invention.

DETAILED DESCRIPTION OF THE INVENTION

The present invention is directed to a method to design mechanical components and mechanisms (bearings, gears, drives, actuators, etc.) using advanced materials that simultaneously possess high required levels of strength and hardness while exhibiting extraordinarily high levels of recoverable strain due to a solid-state phase transformation that occurs when the material is stressed. When these materials are processed in accordance with the principles of the present invention, they are not subject to permanent damage of the contacting surfaces due to excessive shock loads and other forces. The advanced materials selected and engineered to exhibit these qualities are not only ultra-hard, lightweight and wear resistant but possess the exceptional ability to recover large deformations without exhibiting permanent strain damage. When materials with such properties are used in a highly loaded contact application, they resist permanent contact stress damage such as denting, due to overloading events that might occur, such as for example, during the rocket launch of a space hardware system or abrupt landing of an aircraft.

One embodiment of the invention is directed to an ordered, intermetallic, shape memory alloy (SMA) material with: high hardness; an austenite finish temperature ($A_f$) below the intended use temperature of the component formed of the SMA material; and a prestressing or conditioning treatment to eliminate irrecoverable deformation in the SMA material and thereby provide a stable superelastic response, without remnant strain at high stress levels. The prestressing or conditioning can be accomplished by applying an external stress in any manner, such as for example, in a tension mode, a compression mode, a torsion mode, or combinations thereof. While ordered intermetallic shape memory alloys are described, it is also within the terms of the invention to substitute intermetallic shape memory alloys that are not ordered. The present invention is also directed to an ordered, intermetallic, shape memory alloy (SMA) material.

In other words, one aspect of the invention is that by proper materials selection and secondary processing (like coining, deformation, pre-stress), the stress contacts inherent in mechanical devices can be engineered to resist damage.

To fully understand the present invention, a discussion of the state of the art for materials is set forth along with various test results that enables one to appreciate the advancement of the present invention.

Conventional mechanical components are designed to manage, transmit and support heavy loads and forces and to provide a long service life while being of minimal weight and cost. Ball and roller bearings, gears, transmissions and mechanical mechanisms are prime examples of such devices. To achieve sufficient performance, mechanical component construction materials are primarily hard and strong and typically made from tool steel. The very nature of these materials, i.e., their high strength, hardness, high elastic modulus and stiffness, leads to excessively high and damaging stresses whenever loads must pass through small areas of contact such as occur between gear teeth and ball or roller-race interfaces. Though such machine elements can be designed to withstand predictable forces, unexpected and uncontrollable overloads such as vibratory and shock loads often cause stresses at contact points that lead to permanent deformation such as raceway denting. In addition, mechanical component materials, such as tool steel or silicon nitride exhibit limited recoverable strain (typically less than 1%). These material attributes can lead to Brinell damage (e.g. denting) particularly during overload events. Any of these damages typically causes uneven operation and reduces the operating life of the machine elements. The use of softer and more resilient construction materials is not practical because such materials would limit the wear life, the load capacity or result in unacceptably heavy and large systems.

The materials of the present invention are a high Modell (defined as the ratio of the hardness to the apparent effective elastic modulus) material that exhibits superelastic behavior to provide superior tribological performance. The material of the present invention is a shape memory alloy (SMA) material having the following criteria: (1) high hardness (greater than 50 Rc); (2) an austenite finish temperature ($A_f$ below the intended use temperature of the component from which it is constructed (this ensures superelastic behavior for good damage tolerance while avoiding dimensional instability associated with shape memory behavior); (3) an apparent modulus of between 30 and 150 gigapascals (GPa); and (4) that has been prestressed in some fashion to eliminate irreversible deformation in the material providing stable superelastic response, (strains of 3% or more and preferably 3% to 10% based upon current understanding of SMA's) without remnant strains at high stress levels. The preferred material of the present invention includes any ordered, intermetallic, shape memory alloy system including Nitinol, NiTi, NiTiXY (where X, Y could be Hf, Zr, Fe, Pd, Pt, Cu, Au, Cr, Nb and other elements), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior and fit criteria 1, 2 & 3 and have been processed as in (4).

A series of experiments were conducted to assess load-induced damage resistance using the intermetallic nickel-titanium alloy, 60NiTi (60 wt. % Ni—Ti), an example of a shape memory alloy which exhibits superelastic properties and has a high hardness to effective stiffness ratio (Modell). Brinell hardness tests, shock loading tests, elastic indentation tests, compressive tests and ball rebound coefficient of restitution measurements were used to confirm that 60NiTi can withstand far higher compressive loads without incurring permanent damage compared to conventional mechanical component materials. The results indicate that the performance of mechanical systems can be significantly improved by the incorporation of high Modell, shaped memory alloy materials like 60NiTi.

Given the excellent performance of modern machine elements, one could surmise that such systems cannot be improved upon. This is, however, erroneous in one critical respect. The use of hard, stiff and unyielding construction materials for highly loaded contacting elements such as bearings and gears renders the material vulnerable to damage from acute overload events that cause surface denting when stresses exceed the yield strength. This is because contact between curved surfaces made from stiff materials results in very small contact areas. Hence, under load, the local stresses can be very high at the contact areas. In a bearing subjected to a shock load, denting of the otherwise precision raceway can readily occur. This effect is called Brinell type damage. Brinell denting of surfaces often leads to rough operation of the contacting elements and premature fatigue failure. This problem has been dealt with until now largely by limiting overloads.

The term Brinell also refers to a materials test in which a hard round ball is slowly pressed into a flat surface leaving a permanent dent. In effect, a Brinell test is similar to a single ball in a non-rotating bearing undergoing an overload event. In the Brinell test, the size of the dent is then related to a Brinell hardness value; large dents imply a soft material with a low Brinell hardness and small dent diameters correspond to higher Brinell hardness.

There was a line of thinking that a better bearing or mechanical component would result from the use of less rigid, softer materials. However, the use of soft materials leads to loss of load capacity, rigidity, higher operating friction and generally lower fatigue life. Much of these negative effects can be traced to excessive deformation in the contact areas and susceptibility of softer, less rigid surfaces to be damaged by foreign particles like dirt and hard wear debris. Based upon the prevailing and successful use of hard, rigid materials in mechanical components, one can infer that hard and stiff is preferable to soft and less rigid.

Another line of thinking for a more promising approach was to employ materials that are sufficiently hard to mitigate wear but at the same time are sufficiently compliant to minimize contact stress levels during high-load events. In effect, it was thought that what is more desirable for mechanical component applications is the use of hard but highly compliant materials. Such a material may seem like a paradox since hardness and rigidity typically go hand-in-hand.

An additional material property needed for machine components to exhibit superior performance is superelastic behavior (the ability of a material to undergo high levels of strain and still recover.) The description of such a material includes any ordered, intermetallic shape memory alloy system including Nitinol, NiTi, NiTiXY (where X, Y could be Hf, Zr, Fe, Pd, Pt, Cu, Cr, Nb and Au), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior and fit the criteria of having a high hardness (greater than 50 Rc) and an austenite finish temperature ($A_f$) below the intended use temperature of the machine component in which it is used.) Such a material ensures superelastic behavior for good damage tolerance while avoiding dimensional instability associated with shape memory behavior.

However, it has been found that materials that meet these criteria are still deficient for use as mechanical components, such as bearings, gears, and other mechanical mechanisms that typically utilize hardened construction materials to minimize wear and attain long life for components that experience high contact stresses from loaded contact points (e.g., meshing gear teeth, bearing balls-raceway contacts) because such materials exhibit measurable amounts of irrecoverable strain which can lead to a loss of dimensional tolerances for the component.

The present invention has provided the missing link for materials that display shape memory behavior and fit criteria of having a high hardness (greater than 50 Rc); and an austenite finish temperature ($A_f$) below the intended use temperature of the mechanical component so that superelastic behavior for minimum damage is achieved while avoiding dimensional instability associated with shape memory behavior.

According to an embodiment of the present invention, the important requirement or missing link is to prestress or condition the last described SMA material in some fashion to strengthen the material against irrecoverable deformation to provide stable superelastic response when subjected to strains of 3% or more and preferably 3% to 10% without incurring irrecoverable deformation when the material is exposed to high stress levels.

To demonstrate the principle of prestressing superelastic materials, a study of a sample material, that is the ordered, intermetallic alloy Nickel-Titanium (Ni—Ti), was conducted. Nickel-Titanium alloys are an example of the class of materials that can exhibit the characteristics of high hardness, low apparent modulus and superelasticity. These types of materials are in widespread use in the medical and dental industries as well as in the aerospace industry for applications where their biocompatibility and unique superelastic and Shape Memory Effect (SME) characteristics are readily exploited. These applications capitalize upon the large reversible strain change inherent in near equi-atomic Ni—Ti alloys (containing approximately 55 weight percent nickel). In other words, these materials can sustain large recoverable strains. Nonetheless, the use of such alloys in mechanical components is problematic on two fronts. Near equi-atomic Ni—Ti alloys lack the dimensional stability required for precision mechanical assemblies like bearings and gears. When used below their transformation temperature, large dimensional changes, due to easy martensite reorientation, detwinning and other processes related to shape memory behavior are observed. Further, such alloys have low hardness leading to high wear in tribological applications.

Equi-atomic Ni—Ti alloys, however, only represent a small fraction of compositions in the class of materials that potentially exhibit the characteristics of high hardness, low apparent modulus and superelasticity. Within the Ni—Ti system, there exist compositions that when appropriately heat treated and processed exhibit high levels of hardness and dimensional stability. An example of one such alloy is the nickel-rich 60NiTi (60 wt. % Ni—Ti) alloy that contains 60 weight percent (55 atomic %) nickel and 40-weight percent titanium. On the other hand, 55NiTi is soft and exhibits remarkable shape memory effects. Both alloys, 55NiTi and 60NiTi, have apparent moduli comparable to titanium.

The present invention has selected 60NiTi, as representative of an ordered, intermetallic, shape memory alloy system from the group of materials including Nitinol, NiTi, NiTiXY (where X, Y could be Hf, Zr, Fe, Pd, Pt, Cu, Cr, Nb and Au), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior and fit criteria of having a high hardness (greater than 50 Rc and preferably greater than 55 Rc), an apparent modulus of between 20 and 200 GPa and preferably 30 and 50 GPa, and an austenite finish temperature ($A_f$) below the intended use temperature of the component to demonstrate that a material from the group can be made dimensionally stable by removing all evidence of shape memory effect (SME) within the application window for the material and then, where necessary, hardening the material to levels suitable for bearings through appropriate heat treatment. However, it is understood that this list is offered by way of example only and it is within the scope of the present invention to use other alloys selected from the group of ordered, intermetallic, shape memory alloys mentioned hereinbefore.

In testing the 60NiTi, the first step was to produce bearing quality rolling elements that display excellent tribological behavior.

As discussed herein after, a series of experiments were designed to determine the potential for a high Modell material like 60NiTi to offer enhanced performance in a bearing, gear or mechanical component. The sub-component and indirect testing described herein support the concept of making shock resistant components utilizing high Modell materials.

Testing of Materials

Flat plate samples and bearing balls of 60NiTi were tested. As to the 60NiTi balls, they were manufactured via a high temperature, powder metallurgy process. Pre-alloyed 60NiTi powder was HIPed (hot isostatically pressed) into rough, spherical ball blanks that were then ground, hardened, polished, and lapped to produce high quality (Grade 5) bearing balls 12.5 mm in diameter. A multi-step thermal process (heat treatment) was used to enable rough grinding of the bearing balls in a softened state followed by lapping to a very fine surface finish in a final hardened condition. The finished 60NiTi ball specimens are bright and shiny in appearance and resemble conventional polished steel balls.

The 60NiTi plates were made via two slightly different casting methods. One method used vacuum induction skull melting followed by casting into ingots. Once removed from the molds, the ingots were subjected to hot isostatic pressing to consolidate any internal voids remaining from the casting process. In the second method, an electro-slag remelt process followed by hot rolling was used to process the plate.

As to hardening, a simple hardening heat treatment (980° C. for one hour) followed by oil or water quench was used. In smaller samples that were quenched too rapidly, it was necessary to age the material at 400°-500° C. for up to 30 minutes to generate sufficient hardness.

Microindentation hardness measurements of the 60NiTi ball specimens in the final hardened and polished condition resulted in values in the range of 58-62 RC on the Rockwell C scale (RC) in the hardened condition.

For comparison purposes, conventional bearing materials were examined. Plates made from M50 tool steel, 440C stainless steel, and the cobalt alloy Stellite 6B (in the precipitation hardened condition), were prepared and tested. 440C is considered a corrosion resistant bearing material, while Stellite 6B is considered corrosion proof with regards to atmospheric attack. Additionally, commercially available indenter balls from bearing grade $Si_3N_4$ were used.

Experimental Evaluations of 60NiTi Procedures and Results

Several conventional and unconventional experiments were conducted to determine the feasibility of using a high Modell (hard, low effective modulus), superelastic material from a family including 60NiTi, as previously discussed, as a candidate material for mechanical components. These experiments included conventional hardness tests, Brinell damage threshold tests, conventional compression tests, ball crush load tests, shock impact tests, and ball bounce coefficient of restitution (COR) tests. The primary goal of these tests was to evaluate the potential for making machine components from a superelastic and high Modell material, like 60NiTi, that can better withstand dynamic overload forces without incurring permanent damage. Tribological feasibility of alloys like 60NiTi has already been well established.

1. Hardness Test

Standard indentation (Rockwell C indenter) tests were performed on the 60NiTi samples in the cast and hardened conditions. The hardness results for the cast plus hot rolled material were essentially the same as the solely as-cast material. Therefore no distinction among these processing routes is hereafter made. The test material is simply designated either hardened or cast. In the hardness test, a pyramidal diamond indenter is forced into the sample under a 150 kg load. The penetration depth after indent is automatically measured by the test machine and is reported as a numeric hardness value on the Rockwell C scale (RC). Soft materials like mild steel, annealed nickel alloys and titanium typically register in the RC 15-30 range. Hardened bearing steels typically yield values between RC 50 to 65.

Cast 60NiTi is fairly soft and has a hardness value of about RC 24-30. Following heat treatment, its hardness increases to RC 58-60. Despite such a large increase in hardness, casual laboratory measurements and observations suggest that the material is dimensionally stable during the heat treatment with no significant observed warping, shrinkage, expansion or distortion. For comparison, the hardness values for comparable bearing materials were also measured and compared to that of 60NiTi in the Table of FIG. 1. 440C tool steel exhibits hardness that mirrors 60NiTi, i.e., hardness ranging from RC 58-60 with M50 tool steel being slightly harder, RC 60-63. The precipitation hardened cobalt alloy, Stellite 6B, was slightly softer, RC 44-46, than the hardened 60NiTi. For long life and maximum load capacity, material hardness above RC 50 is generally preferred for bearing and gear applications.

2. Brinell Indentation Hardness Test

The Brinell hardness test consisted of pressing a large diameter (12.7 mm) ball into the surface of a plate of test material, beyond the yield strength, resulting in a round and permanent dent. The size of the dent and the ball along with the load are used to calculate the Brinell hardness. The higher the number, the more resistant a material is to indentation damage. In these tests, $Si_3N_4$ and hardened 60NiTi balls were used to indent plates of 60NiTi, 440C and M50 bearing steels and Stellite 6B. The test load is applied gradually over a 120 second period and varied from 10 to 3000 kgf depending upon the material tested. The test setup is shown in FIG. 2 where a load bar 20 drives an indenter ball 22 towards a test plate 24.

FIG. 3 is a chart that contains the measured Brinell hardness values for the various bearing materials. When the silicon nitride indenter 22, as shown in FIG. 2, was used, the data indicated that 60NiTi has the highest Brinell hardness at 531, followed by M50 at 493, 440C at 434 and Stellite 6B exhibiting the lowest value of 302. Clearly, 60NiTi has an excellent resistance to indentation damage but the Brinell number alone does not give a full picture of 60NiTi's damage resistance, which is more fully delineated in the following tests.

A follow-on measurement was made with the Brinell test set up in which loads were applied to the specimens using silicon nitride and 60NiTi balls at levels below those needed to cause dents. In these tests, low loads were placed on the indenter ball 22 and then removed. If no dent was observed, a new test was done using a higher load. The process was repeated until the damage threshold load was determined. This threshold load, given in the table of FIG. 4, represents the maximum force the surface can withstand without incurring permanent damage. The threshold load is important in engineered systems since this threshold load and not a hardness number, is used to determine the machine design. The table of FIG. 4 gives these threshold loads along with corresponding stress values calculated using the Hertz equations.

These results illustrate the value of using hard but highly recoverable materials in concentrated contacts. When Stellite 6B is indented with $Si_3N_4$ or 60NiTi balls above 10 and 15 kgf, respectively, these lighter loads lead to denting. 440C can withstand 51 kgf and 150 kgf, and M50 can withstand 150 and 501 kgf when loaded with $Si_3N_4$ and 60NiTi balls, respectively. 60NiTi exhibited the most dent resistance by far, withstanding 552 kgf against $Si_3N_4$ and 1512 kgf when contacted by the 60NiTi ball. Clearly, using highly recoverable materials like 60NiTi for one or both contacting surfaces leads to dramatically enhanced loading capability.

3. Compression Test

The most generally accepted and broadly understood test data comes from simple compression tests conducted on small cylindrical samples in a servo-hydraulic test frame, with the sample being the part depicted between 52 & 54. In this test, 5 mm diameter by 10 mm long cylinders of 60NiTi were placed between a pair of hardened steel anvils 56,58 in a servo-hydraulic test frame, as shown in FIG. 5, and deformed in strain control by applying forces $F_1$, $F_2$ (where $F_1=F_2$) at an initial strain rate of approximately $1\times10^{-4}$ $s^{-1}$ while measuring strain as a function of applied stress. Repeated cycles were imposed on the same sample to a constant upper stress level determined from previous compression tests. The data is presented as stress versus strain from which the strength, apparent stiffness and recoverable strain levels are assessed.

FIG. 6 shows a graph of the compression test results for six (6) repeated stress cycles on the same specimen. When initially loaded in compression, the 60NiTi sample deforms as the load increases in a slightly non-linear fashion up to the load limit capability of the test fixtures, in this case ~2500 MPa. When the load is reduced, ~5% strain is recovered, while an irrecoverable strain of ~1% was left. Upon repeated loading, the sample deforms reproducibly between the same limits, without further irrecoverable deformation, with only a small hysteresis observed between the loading and unloading segments. Subsequent loading cycles show little deviation from this reproducible behavior.

Two important aspects of the material behavior are revealed from this test. One aspect is that a small amount (~1%) of irrecoverable strain occurs during the very first loading event. The implications of this one-time initial ~1% irrecoverable strain will be discussed herein after. The other important aspect is that 60NiTi can withstand exceedingly large amounts of recoverable strain over repeated cycles with no observed degradation. Typical bearing steels can withstand only a few tenths of one percent strain and fully recover when the load is removed.

4. Ball Crush Test

A ball crush test was used to further determine the resiliency of 60NiTi compared to conventional mechanical component construction materials. In this procedure, a test ball 70 of 60NiTi or tool steel was placed between hard ceramic composite plates, such as 72 and 74 in FIG. 7. The separation gap d between the plates was assessed (witnessed) with soft aluminum witness balls 71 placed adjacent to the hard test ball 70. The hard ceramic composite plates 72,74 were then forced together under high loads in an effort to crush the test balls 70. As the plate separation gap d decreased, the test ball deflected.

FIG. 7 is a schematic of the ball crush test set-up. At first, under low loads, the test ball 70 elastically deforms. If the upper and lower anvil plates 72, 74 are then separated the test ball 70 springs back to its original shape and size. The soft aluminum witness ball 71 also experienced plastic deformation and remained approximately the final size it reached during the crush test. The measured distance between the flat spots on the aluminum ball 71 represents the shape of the test ball 70 during the loading test. To complete the testing, a new aluminum ball 71 is then placed alongside the hard test ball 70 and the load on the plates 72,74 is increased to the next level. Repeated loading at ever increasing loads continues until permanent flat spots appear on the surface of the hard test ball 70. When this occurs, the load to cause permanent deformation or crush load limit is determined. Further, by measuring the size of the aluminum witness ball 71, the approximate maximum recoverable deformation of the test ball 70 can be determined.

The test results clearly show that the 60NiTi balls can incur large amounts of deformation compared to the tool steel balls. When a 6.3 mm diameter 60NiTi ball was loaded to 1454 kgf, no permanent damage occurred even though the aluminum witness ball indicated that the diameter during the test had decreased through strain to 6.0 mm or less. This represents a~4% recoverable strain limit for 60NiTi and compares well to the standardized compressive strain tests described earlier. Comparable tests of conventional tool steel balls exhibit permanent damage at far lower strains and loads.

5. Impact Test

FIG. 8 is a schematic illustration of a shock test or impact test set-up 80. The test setup 80 includes a test specimen 82; a hardened ball 84, a drop weight 86 (such as a cylinder) spaced a distance e from the hardened ball 84. At low drop heights e, the impact forces of the drop weight 86 on the hardened ball 84 and then onto the test specimen 82 are modest. At higher drop heights, the forces are higher and the damage to the test plate 82 is evidenced by the permanent dents made in the plate 82 by the ball 84. Small dents indicate a high resistance to shock overloads. Large dents indicate a high susceptibility to shock damage. Since the load between the ball and test plate specimen is a function of the duration of the impact event and this is not strictly known, this test only serves as a qualitative measure of shock resistance. In an impact test, using the test setup of FIG. 8, a 12.7 mm thick flat plate of hardened (RC 60) 60NiTi or 440C tool steel is placed upon a rigid, heavy steel table (not shown). A hardened ball 84 (12.7 mm diameter) is placed on top of the plate 82 and impacted with a steel cylinder 86 (5.8 kgf, 12.75 pounds) by dropping the cylinder onto the ball 84 from heights ranging from 12 to 88 mm (0.5 to 3.5 inches). The energy of the impact between the weight and the hardened ball (made from either M50 tool steel or silicon nitride) causes the ball to press into the surface of the plate 82.

The test results given in the table of FIG. 9 clearly show that 60NiTi is not dented and therefore indicates its high resistance to shock load damage. The 440C steel plate is readily dented by the M50 tool steel ball when impacted by the test weight from a height of only 12 mm but no denting was observed in the 60NiTi plates from a similar impact. When a $Si_3N_4$ ceramic ball was used as the indenter, a 1 mm diameter dent resulted in the 440C plate when the weight was dropped from a height e of only 6 mm. In contrast, the 60NiTi plate resists denting by impact from the tool steel ball 84 up to a drop height e of the drop weight 86 in excess of 25 mm. When the $Si_3N_4$ ball is used, only a slight depression is observed in the 60NiTi plate for a 25 mm drop height e. Based upon approximate stress calculations for these tests, it appears that 60NiTi is at least four times more resistant to shock load damage than conventional bearing steels.

6. Ball Bounce Coefficient of Restitution (COR) Test

The final test for determining the resiliency of 60NiTi compared to conventional bearing materials is derived from ball bounce tests also known as COR (coefficient of restitution) measurements. In this test, 6.3 mm diameter test balls are dropped from varying heights onto hardened steel plates. Depending upon their resiliency and characteristic deformation response (for traditional materials, the elastic response) the balls rebound to different heights. The ratio of bounce height to original drop height is called the coefficient of restitution or COR. The rebound velocity is also often measured and can be used to calculate this height and the COR based upon simple kinetic modeling. Materials with a low COR absorb much of the energy developed during impact and internally dissipate this energy as heat. Such materials are sometimes referred to as well damped. Tungsten carbide is a good example with a COR of around 0.5. If dropped from a height of one meter, a tungsten carbide ball will rebound to a height of about one-half meter. Materials with a high COR do not suffer such energy losses. The hard rubber used for superballs is a good example of materials with a high COR (typically around 0.75). Brass has a COR of about 0.7. There is no distinct relationship between hardness, a materials ability to withstand penetration by a sharp, hard indenter, and the COR.

When 60NiTi is tested for COR, the results reflect that the unusual and unique characteristic deformation behavior found in this material is consistent with the unique behaviors observed in the other previously described test results.

FIG. 10 shows the COR test results. Two COR curves for 60NiTi are shown. One curve resembles the behavior of brass and represents balls (COR of ~0.75) that have undergone the standard heat treatment and polishing procedure. The other curve is much higher with a COR of about 0.85. These balls were subjected to high crush loads (strain) before bounce testing. This increase in the observed COR may reflect the elimination of irrecoverable strain, as exhibited in the very first cycle of the compression tests presented earlier.

The various tests described herein before were used to assess the potential for highly recoverable, hard materials that have an austenite finish temperature ($A_f$) below the intended use temperature of the component to ensure superelastic behavior for good damage tolerance while avoiding dimensional instability associated with shape memory effect behavior; and that have been prestressed in some fashion to eliminate irrecoverable deformation in the material providing stable superelastic response, (strains of 3% or more and preferably 3% to 10%). This description includes any shape memory alloy system including Nitinol, NiTi, NiTiXY (where X, Y could be Hf, Zr, Fe, Pd, Pt, Cu, Cr, Nb and Au), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior and fit the criteria of being a highly recoverable hard material, that have an austenite finish temperature ($A_f$) below the intended use temperature of the component, and that have been prestressed or conditioned to eliminate irrecoverable deformation in the material providing stable superelastic response.

A series of novel and conventional experimental measurements were used to provide input for such an assessment of a suitable material. The results of these experiments are remarkably consistent and support the validity of using superelastic materials for mechanical components.

Using the most basic tests, Rockwell and Brinell hardness, 60NiTi's Brinell hardness is around 530 and its Rockwell C hardness is 60-62. These values indicate good prospects for use in highly concentrated contacts. Both of these traditional tests press a hard indenter into the surface to be tested at sufficiently high load to yield the material leaving a permanent indent.

The conventional compression test is often used to assess elastic behavior prior to the onset of permanent damage and it is during this test that the unique and unusual deformation behavior of 60NiTi is observed. The compressive behavior of 60NiTi differs substantially from other hardened bearing materials. Hard bearing materials have low strain to failure, typically 1% or less. Thus, they are brittle. 60NiTi, in contrast, is superelastic. Its stress strain curve is complex as shown in FIG. 6. On the first loading cycle, strain builds slowly over a broad strain range. At more than 5% strain and 2.5 GPa load, the test fixture has reached its contact load limit. The load is then reduced and when fully unloaded we can see that over 4% of the strain is recovered. Subsequent loading cycles exhibit only fully recoverable pseudoelastic response. In the current set-up, the maximum allowable strain is not reached or measured. Based upon the slope of the stress-strain curve and the result from the Brinell threshold load limit tests that showed irrecoverable deformation only above 5.7 GPa, one can extrapolate that the recoverable strain limit lies near 10%.

In comparison to conventional bearing steels, 60NiTi exhibits remarkably high levels of recoverable strain. 60NiTi is hard, yet combines a low apparent modulus and an extraordinarily extended recoverable deformation region. To determine if the behavior observed in a conventional compression test translates to a real engineering component one needs only examine the results from the ball crush test. In the ball crush test, 6.3 mm hardened 60NiTi balls endured at least 4% deformation and were able to fully recover. This level of recoverable deformation compares favorably with the compression tests using standard cylindrical specimens even though the geometry differed significantly.

Highly deformable materials that can also withstand high levels of recoverable strain are more forgiving to overload events. Under extreme loads, such surfaces will momentarily deform creating a larger contact with commensurately lower contact stress and reduced chance for permanent damage. Highly recoverable materials can also withstand debris by temporarily deforming to accommodate the overrunning of a hard particle rather than incurring a permanent dent through plastic flow. Interestingly, the ball bounce coefficient of restitution tests shed some light on the strain experiments.

Two types of 60NiTi balls were subjected to COR testing. The initial set tested used test balls previously tested in the ball crush test at levels below their deformation limit. In other words, they were pre-strained to some extent. These balls exhibit an unusually high COR of 0.8, comparable to rubber balls used for a child's toy "Super" balls. When identical 60NiTi balls, from the same manufacturing lot but not pre-strained, were tested they yielded slightly lower COR values of about 0.7. This difference may well be related to the compression test observation that suggests that upon the first load cycle the strain is only partially recoverable. However, the necessary pre-strain needed to attain fully recoverable deformation could be achieved via a coining, cold forging, or other suitable mechanical treatment of the hardened component prior to final finishing.

Nonetheless, the high COR's for 60NiTi mean that the energy of impact that is briefly stored during the impact event prior to rebound, is efficiently released with little dampening effect or loss. In a highly loaded rolling or other contact such as would be encountered in a bearing or gear or other mechanism, repeated deformation will not result in energy absorption, dissipation or loss. In other words, machine elements made using such materials will not suffer from efficiency loss during inelastic (by definition "elastic" deformation is fully recoverable) processes and may exhibit lower friction.

FIG. 11 shows the friction coefficients for 440C and 60NiTi balls rolling on 440C plates in a tribometer test setup. Friction for 60NiTi is consistently lower than for 440C. While the exact reason for the lower friction with 60NiTi is not yet fully understood, it is thought to be related to the superelastic behavior of the ball. Based upon these considerations, lower friction and higher overall efficiency of bearings, gears, drives and mechanical components may be expected.

The Brinell style indentation experiments used to determine the load threshold for permanent damage provides compelling evidence that a superelastic material can contribute to improved mechanical components and devices. The threshold load for damage for the 60NiTi system (ball and plate) is at least an order of magnitude higher than the best hybrid bearing system currently in use. The reason for this behavior can be best understood through the contact stress modeling embodied in the hertz equations. For a given contact geometry, the stress between a ball and plate is dictated solely by the effective modulus of the ball and plate and the load.

The Table of FIG. 4 lists the results. The lower apparent stiffness of 60NiTi results in a larger deformed contact area and thus the peak and average stresses are reduced compared to materials with higher moduli. 60NiTi's superelastic behavior enhances this effect in two ways. First, the superelastic effect causes the 60NiTi to appear to have an even smaller "effective" modulus further reducing peak stresses. Second, the superelastic effect gives 60NiTi the ability to recover from extremely large strains even when subjected to high damage threshold loads.

The behavior of 60NiTi, as observed in this series of experiments, is perfectly understandable once these effects are taken into account. Further, such tolerance to concentrated loads can be extended to mitigate damage by hard foreign particles such as might occur when a bearing ball rolls over a sand particle. Superelastic bearings may well simply deform around the particle and pass by without incurring permanent damage rather than sustaining a dent. Again, the combination of low apparent modulus and high recoverable strain imparts load tolerance and the high hardness gives good wear resistance.

FIG. 12 graphically depicts the combined benefits of this novel approach with respect to load damage tolerance and environmental corrosion. 60NiTi's additionally attractive properties of low density, intrinsic corrosion resistance and non-magnetic properties add to the compelling case that it is representative of a shape memory alloy system from the group of materials including Nitinol, NiTi, NiTiXY (where X, Y could be Hf, Zr, Fe, Pd, Pt, Cu, Cr, Nb and Au), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior and fits the criteria of having a high hardness (greater than 50 Rc) and an austenite finish temperature ($A_f$) below the intended use temperature of the component so that only superelastic behavior can occur during application, a stable superelastic response without irrecoverable deformation at strains of at least 3%, and an apparent modulus of between 20 and 200 GPa. Hardening of the alloys may depend on the development of heat treatments specific to each alloy. A representative hardening treatment for 60NiTi might include heating the component to about 950 degrees C. for one hour followed by rapid cooling (quenching) in water or oil. An aging step may be added to enhance properties that consists of heating the quenched component to between 350 and 600 degrees C. for 0.2 to 4 hours followed by cooling to room temperature.

The present invention presents a novel approach to improve the resiliency, debris and shock load tolerance and efficiency of mechanical components through the conditioning of hard yet superelastic construction materials. Through a series of materials tests, it has been shown that when properly conditioned, low apparent modulus, hardened superelastic materials, of which 60NiTi is representative, can withstand extreme loading conditions without incurring irrecoverable surface damage. In contrast, bearing and gear materials currently in widespread use readily sustain damage at much lower loading levels. The test results described hereinafter, when taken together, indicate that the superior performance of loaded contacts made from the conditioned hard superelastic material is directly related to it's unique combination of high hardness, significantly reduced "effective" modulus and extremely high levels of recoverable strain (superelastic behavior). Based upon the investigations, the following has been ascertained.

The use of hardened materials with modest effective modulus that exhibit superelastic behavior results in significantly enhanced load capability for contacting surfaces.

Conventional bearing and component materials require high hardness that is normally coincident with highly rigid materials. These properties lead to damagingly high and localized contact stresses in machine elements. This behavior is manifested by the impact and indentation tests that conclusively show that even modest loads result in permanent damage to conventional materials.

The extreme recoverable deformation that occurs when superelastic, low effective modulus materials, of which 60NiTi is representative, are placed under heavy contact loads results in larger hertzian contact areas that effectively distribute the load, reduce peak and average stresses and prevent contact damage.

60NiTi appears to undergo a small amount of irrecoverable deformation during initial loading. After that, it exhibits remarkably reversible, superelastic strain behavior as evidenced by both the standard compression tests and the ball rebound tests. These observations indicate that some mechanical working of the materials of the present invention, such as coining, forging or other suitable mechanical treatment that imparts appropriate pre-strain, is required prior to use.

The test results presented herein after show that the relative ranking for load tolerance for various contacting material pairs corresponds to published material properties and calculated stress levels.

When the exemplary load tolerance of 60NiTi is taken with preconditioning, its previously proven benign tribological behavior demonstrates a significantly enhanced machine component performance of conditioned superelastic, low effective modulus materials, described above.

When one considers that the 60NiTi material is the least complex superelastic alloy currently available, it is likely that through alloying and other development, materials with greatly enhanced performance will emerge.

Conditioning the Shape Memory Alloy

An important aspect of the present invention is to provide a method that can be configured to establish a stabilization point for the superelastic material when used in a component, where the material will exhibit good superelastic behavior with little or no attendant irrecoverable strain, by applying stress to the material in tension, compression, torsion or any combination thereof to strengthen the material against irrecoverable deformation during the service life of the component. The SMA is selected from the group of materials including Nitinol, NiTi, NiTiXY (where X, Y could be Hf, Zr, Fe, Pd, Pt, Cu, Cr, Nb and Au), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior and fit the criteria of having a high hardness (greater than 50 RC) and an austenite finish temperature ($A_f$) below the intended use temperature of the component; and can be made dimensionally stable by removing all evidence of irrecoverable deformation through conditioning.

By applying stress to the SMA in tension, compression, torsion or any combination thereof to some upper stress limit, the material can be stabilized against irrecoverable strain and other inelastic deformation mechanisms so that only large recoverable strains will occur up to that stress limit. If the material does not stabilize after the first application of the stress, the application of stress cycles continues until the material is stabilized, i.e., there is no change in strain at stress and after unloading compared to the previous cycle.

In other embodiments, the process is performed by a single isothermal loading to achieve stabilization. A hydraulic test frame, a hydraulic piston, or any suitable equipment capable of producing a thermomechanical loading of the sample may be used. These include commercial operations such as forging, coining, closed die extrusion, and any related processes well known to those experienced in the art of thermo-mechanical processing. Once the stress under isothermal conditions, required to achieve stabilization is known, the same stress or procedure can be utilized to train (or stabilize) the remaining or similar SMA material.

FIG. 13 illustrates a method for performing isothermal mechanical loading to a sample of a SMA, in accordance with one or more embodiments of the present invention, to determine the upper level of stress that can be applied to the SMA during the stabilization process. In this embodiment, at 131, a temperature is set to a constant, the temperature being some temperature above the austenite finish temperature of the SMA and below the recrystallization temperature for the alloy. As the temperature remains constant, a large or sufficient amount of stress at 132 is applied on the sample of the SMA until failure. In this embodiment, depending on the mode of loading, failure can be breaking, fracturing, buckling or bulging depending on the mode of applied stress. At 133, a plurality of strains are measured and recorded according to different amounts of stress being applied on the sample until failure. From the data determined in FIG. 13, a stress is chosen for isothermal conditioning of the SMA. The stress is chosen at a maximum level required for the particular application and below the failure stress determined in FIG. 13. This chosen stress level can now be used to train other pieces or the remaining SMA using an isothermal treatment, as shown in FIG. 14.

Stated another way, the isothermal monotonic response strain determines the amount of loading required in the isothermal state in order to achieve a strain state that would stabilize the material for the service conditions of interest. Once the required loading amount is determined, then the method of training other pieces or the remaining SMA using an isothermal treatment can be achieved. As a result, such embodiments can significantly reduce the amount of time required to stabilize the stress-strain response of the SMA. In addition, such embodiments not only reduce the cost, but also improve viability of utilizing superelastic SMAs in various bearing, gears, and other turbomachinery applications.

FIG. 14 illustrates a method of performing isothermal, mechanical cycling to a sample of a SMA, in accordance with some embodiments of the present invention. In this embodiment, an isothermal mechanical cycling experiment is performed on the sample of the SMA by applying a level of stress on the sample and unloading followed by repeated loading and unloading until the material is stabilized. In other words, the isothermal mechanical cycling experiments are performed until the strain of the isothermally cycled sample of the SMA at stress and also after unloading is unchanged from the previous stress cycle. Once this condition is met, the sample has been conditioned and is ready for use. Conditioning may require only one cycle to stabilize the material and once confirmed that the chosen stress—temperature condition is suitable for stabilizing the material, all other material can be treated under similar conditions.

Referring to FIG. 14, at 141, a constant temperature is set. This temperature is generally above the austenite finish temperature ($A_f$) for the alloy and below the recrystallization temperature. For example, in most embodiments, the constant temperature is the same as the temperature used in reference to FIG. 13. However, in other embodiments, the constant temperature can be set to any temperature between $A_f$ and the recrystallization temperature of the alloy, as long as the temperature remains constant and there is sufficient strain capability in the material to load to the desired stress level without failure. The desired stress level is a level of stress required for operation of the component material but below the failure stress of the alloy. From 142 to 145, the sample is mechanically cycled by applying the specified level of stress on the material and then unloading the sample. Steps 142 to 145 are repeated until the strains measured at stress and after unloading are approximately the same as those strains in the previous cycle. Consequently, a minimum of 2 cycles is required to determine whether the treatment is sufficient to stabilize the material, though in practice additional cycles may be necessary to fully condition the material.

At 142, a predetermined amount of stress is applied on the virgin sample with the temperature remaining constant and a corresponding strain is recorded at 143. In some embodiments, a hydraulic test frame, a hydraulic piston, or any suitable equipment capable of producing a thermo mechanical loading of the sample may be used. For example, to isothermally, mechanically condition the sample for use in bearing, gear or other turbomachinery applications, any type of structure or pressure unit may be used to increase the load or stress on the sample and control the amount of deformation placed into the material.

At 144, the predetermined stress on the sample is removed or unloaded (i.e. stress is reduced to zero) and the corresponding strain is measured/recorded at 145. At 146, the strain on the sample, at stress and after the stress has been removed, is compared to the corresponding strains recorded during the previous cycle. A minimum of two stress cycles is required to substantiate whether the material has been fully conditioned. The comparison can be performed by a determining unit, which can be any type of computer processing equipment. If the strain on the sample is not equal to the strain determined from the previous cycle, within reasonable limits, then the stress is cycled again at the same level at 147, and steps 142 to 146 are repeated. If the strains at stress and after unloading the sample during the current stress cycle are essentially equal to those strain levels determined during the previous cycle, then at 148 a stress level corresponding to the equivalent strain and the number of cycles required to stabilize the material is determined. This corresponding stress level and number of stress cycles can now be used to train other pieces or the remaining SMA under an isothermal treatment, as shown in FIG. 15.

In another embodiment of this invention, the stress applied after step 147 can be increased over the stress applied during the previous cycle. The stress cycling is repeated (steps 142 to 147) for one or more cycles at this higher stress level and then the stress is returned to the original stress level for subsequent cycles and the material cycling is continued until the material is stabilized. Other variations of this stress cycling may also be utilized as would be clear to those with experience in the art of thermomechanical processing.

FIG. 15 illustrates a method of performing isothermal treatment on an object comprised of the SMA, in accordance with one or more embodiments of the present invention. The depicted method generally describes conditioning an object of a piece of SMA from the sample used in the steps of FIG. 14 or a piece of SMA having the same properties as the SMA used in the steps of FIG. 14. After determining the amount of stress and number of cycles required to produce a stabilized strain, as shown in FIG. 14, an object is selected to be trained under the isothermal treatment, as in step 151. At step 152, the treatment temperature is set as determined in the process described for FIG. 14. At step 153, a targeted stress value, as determined in the process of FIG. 14, is applied to the object of the SMA. The targeted stress value is based on the stress value determined from the method illustrated in FIGS. 13 and 14, i.e., the stress value to achieve a stabilized strain. At step 154, the targeted stress value is unloaded from the object of the SMA. If more than one stress cycle was required to stabilize the material in FIG. 14, then steps 153 and 154 are repeated "N" times. "N" being the number of cycles determined in FIG. 14 to stabilize the strain response of the material. As a result, a single loading and unloading of the targeted stress value can be used to stabilize the strain response of the SMA object, i.e., a bearing, gear or turbomachinery element of interest. In any case, the process of stress cycling is repeated "N" cycles until the strain response of the object is stabilized.

The method steps performed in FIGS. 13-15 may be performed, in part, by a computer program product, encoding instructions for a nonlinear adaptive processor to cause at least the methods described in FIGS. 13, 14, and 15 to be performed by the apparatuses discussed herein. The computer program product may be embodied on a computer readable medium. The computer readable medium may be, but is not limited to, a hard disk drive, a flash device, a random access memory, a tape, or any other such medium used to store data. The computer program product may include encoded instructions for controlling the nonlinear adaptive processor to implement the method described in FIGS. 13-15, which may also be stored on the computer readable medium.

The computer program product can be implemented in hardware, software, or a hybrid implementation. The computer program product can be composed of modules that are in operative communication with one another, and which are designed to pass information or instructions to display. The computer program product can be configured to operate on a general purpose computer, or an application specific integrated circuit ("ASIC").

Another embodiment of the present invention relates to a class of lightweight materials known as "ordered intermetallics" that perform well in sliding wear applications using conventional liquid lubricants and are therefore suitable for high performance mechanical components such as gears and bearings.

Materials for high performance mechanical components must include a number of qualities including: hard for wear resistance; tough to resist fracture; high strength-to-weight ratio (known as specific strength) to reduce weight for certain applications, such as aerospace components; corrosion resistance when the article is stored or used in or near a moist or humid environment or even salt water environments.

As discussed above, bearing and gear designers currently select steels (such as 440C stainless steel) or ceramics (such as silicon nitride). While steels have good stiffness, hardness and toughness, they are prone to corrosion, some can be magnetized and lack the higher specific strengths of many other materials. While ceramics have high stiffness, hardness, specific strength and are corrosion resistant, they have very low toughness and are not conductive (allowing static charges to build, which can be detrimental and damaging). The present invention is directed to a material with a combination of the beneficial properties of steel and ceramics.

In the past, titanium and titanium alloys were thought to be unsuitable for lubricated tribological applications because titanium is very reactive and will react with the lubricant and cause failure of the mechanical system, such as a ball bearing. Intermetallics (including those containing titanium) were previously overlooked for application in a mechanical system because of the inherent brittleness of some ordered intermetallics.

Due to processing breakthroughs, ordered intermetallics can now serve as mechanical components where the unique combination of physical properties of ordered intermetallics including high hardness, good dimensional stability, high specific strength and excellent corrosion and environmental resistance are required.

According to an embodiment of the present invention, the friction and wear of several ordered intermetallic materials were measured to determine which could perform well under lubricated tribological conditions. Ordered intermetallic materials are a class of materials that exhibit properties similar to both metals and ceramics. Because of the strict ordered arrangement of atoms within intermetallic materials, the atoms are not as free to slip past one another when subjected to deformation as in metals and therefore tend to have high hardness.

For example, FIG. 16 shows a common arrangement of atoms for ordered intermetallic materials known as the B2 crystal structure. In this arrangement, atoms of one type (i.e., Ni) are at the eight corners of a cubic cell and an atom of a second type (i.e., Ti) is located at the center of the cubic cell. This structure is then repeated in all three dimensions in space, describing an alloy of 50% of each of the atomic species (i.e., NiTi). This is a relatively simple ordered crystal structure that allows the material to easily deform by dislocation motion instead of fracturing.

More complex crystal structures present greater impediments to dislocation motion thereby reducing ductility and increasing the likelihood of brittle fracture. It is because of the inherent brittleness of some ordered intermetallics, that early work on intermetallic systems was stymied due to concerns over low fracture toughness. However, techniques have been since developed to enhance the toughness of a number of alloys. Ordered intermetallic systems consisting in part of light weight structural metals such as titanium and aluminum can have impressive specific strengths and can be non-magnetic and essentially corrosion-proof.

Due to the unique combination of the aforementioned properties, these types of ordered intermetallics are especially attractive for tribological applications. Specifically, materials that include any shape memory alloy system including Nitinol, NiTi, NiTiXY (where X, Y could be Hf, Zr, Fe, Pd, Pt, Cu, Cr, Nb and Au), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior and fit the criteria of being a highly recoverable hard material, that have an austenite finish temperature ($A_f$) below the intended use temperature of the component, and that have been prestressed or conditioned to eliminate irrecoverable deformation in the material providing stable superelastic response.

Recently, it has been found that 60NiTi, an ordered intermetallic composed of 60 weight percent nickel and 40 weight percent titanium (~55 at. % Ni and 45 at. % Ti) and representative of the directly above mentioned materials, was a candidate for bearings and mechanical components. 60NiTi displayed good tribological performance. This performance was attributed to the dimensional stability, high hardness (wear resistance), and chemical compatibility with lubricants of 60NiTi, which is in stark contrast to conventional Ti alloys that exhibit exceptionally poor performance and galling when lubricated.

Based on these results, good tribological performance is expected for several other ordered intermetallic materials including titanium aluminide alloy ($Ti_3Al$—Nb), cobalt-titanium ($Co_3Ti$), and iron titanium (FeTi).

Tribological testing of titanium aluminide was performed using the tribometer shown schematically in FIG. 2. In this test, a load bar or rider 20 having a hemispherically shaped tip 25 made of a relatively hard tool steel (M50 tool steel) was loaded against a flat disk 24 of titanium aluminide. The load on the rider 20 was 500 g. The disk 24 rotated at 1 m/s for one hour. The friction force exerted on the rider by the moving disk was measured by a load cell through a gimbaled lever arm. Prior to the test, a dab of a commercially available perfluorinated polyether lubricant was applied to the surface of the disk 24. After the test, the wear on the rider 20 was determined by measuring the diameter of the circular wear scar on the tip of the rider and calculating the volume lost. Wear of the disk was determined by measuring the cross-sectional area of the wear track left in the disk at eight locations with a profilometer. The volume of material lost was then calculated based on the average cross-sectional area removed and multiplied by the circumference of the wear track.

The results of tribology testing are shown in FIG. 17. These results show that the titanium aluminide disk had 54% less wear than the titanium disk. Also, the rider against the titanium aluminide disk had approximately 17% less wear than the titanium disk rider. The test results also showed that when the tool steel rider was run against the titanium disk, there was galling of the disk. With the titanium aluminide disk, only abrasive wear was observed.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A material for use as a component, comprising:

a nickel-rich intermetallic material having highly elastic behavior devoid of irrecoverable strains, that when stressed, exhibits recoverable strains of at least 3%; and wherein said material has a hardness of at least 50 on the Rockwell C scale and is dimensionally stable, devoid of dimensional and phase instabilities.

2. The material of claim 1 wherein the component is a mechanical component which can withstand strains of between about 3% and 10% and is devoid of irrecoverable strains.

3. The material of claim 1 wherein the material has a hardness of at least 55 RC.

4. The material of claim 1 wherein the material is an ordered intermetallic material selected from the nickel-rich group consisting of Nitinol, NiTi, and NiTiXY where X and Y are selected from the group consisting of Hf, Zr, Fe, Pd, Pt, Cu, Cr, Nb and Au.

5. The material of claim 4 wherein the intermetallic material is selected from the group of materials having the qualities of being corrosion resistant, electrically conductive, shock proof, capable of undergoing a martensitic phase change, and benign to a lubricant.

6. The material of claim 1 wherein the component has an apparent modulus of between 20 and 200 GPa.

7. The material of claim 6 wherein the component has an apparent modulus of between 30 and 50 GPa.

8. The material of claim 1 wherein the intermetallic material has been conditioned to remove attendant irrecoverable strains in the material at strains of at least 3%.

9. The material of claim 8 wherein the intermetallic material has been conditioned by applying stress to the material.

10. The material of claim 9 wherein the intermetallic material has been conditioned by a stress selected from the group consisting of tension, compression, torsion, and combinations thereof.

11. A mechanical component for tribological applications, comprising;

an ordered intermetallic material selected from the nickel-rich group consisting of Nitinol, NiTi, and NiTiXY: where X and Y are selected from the group consisting of Hf, Zr, Fe, Pd, Pt, Cu, Cr, Nb and Au, the ordered intermetallic material is a hard material having a hardness of at least 50 on the Rockwell C scale and is dimensionally stable, devoid of dimensional and phase instabilities, and the ordered intermetallic material has been conditioned to eliminate irrecoverable deformation in the ordered intermetallic material providing stable superelastic response.

12. The mechanical component of claim 11 wherein the component has stable superelastic response devoid of remnant strains but providing recoverable strains of at least 3%.

13. The mechanical component of claim 11 wherein the component can withstand strains of between about 3% and 10% and is devoid of remnant strains.

* * * * *